US006196524B1

(12) United States Patent
Jourdan et al.

(10) Patent No.: US 6,196,524 B1
(45) Date of Patent: Mar. 6, 2001

(54) FUEL ENRICHMENT SYSTEM

(75) Inventors: Donovan K. Jourdan; Henry C. Billingsley, both of Kenosha, WI (US); Jeffrey A. Berg, Winthrop Harbor, IL (US)

(73) Assignee: Outboard Marine Corporation, Waukegan, IL (US)

( * ) Notice: Subject to any disclaimer, the term of this patent is extended or adjusted under 35 U.S.C. 154(b) by 0 days.

(21) Appl. No.: 08/130,633

(22) Filed: Oct. 1, 1993

(51) Int. Cl.[7] ..... F02M 1/10

(52) U.S. Cl. ..... 261/39.2; 261/39.5; 261/121.4; 261/DIG. 8

(58) Field of Search ..... 261/39.2, 39.5, 261/DIG. 8, 121.4

(56) References Cited

U.S. PATENT DOCUMENTS

| | | | | |
|---|---|---|---|---|
| 2,230,184 | | 1/1941 | Horton | 123/179 |
| 2,667,154 | | 1/1954 | Ball | 123/179 |
| 2,868,185 | * | 1/1959 | Bellicardi | 261/39.5 |
| 3,246,886 | * | 4/1966 | Goodyear et al. | 261/39.5 |
| 3,249,345 | * | 5/1966 | Gast | 261/39.5 |
| 3,706,444 | * | 12/1972 | Masaki et al. | 261/39.5 |
| 3,780,718 | * | 12/1973 | Nambu et al. | 261/39.5 |
| 3,934,571 | * | 1/1976 | Mennesson | 261/39.5 |
| 3,942,494 | * | 3/1976 | Toda et al. | 261/39.2 |
| 4,069,802 | * | 1/1978 | Ross | 261/39.5 |
| 4,094,931 | * | 6/1978 | Karino | 261/39.5 |
| 4,104,337 | * | 8/1978 | Garcea | 261/39.2 |
| 4,311,129 | | 1/1982 | Kakizaki et al. | 123/588 |
| 4,377,150 | | 3/1983 | Kitamura et al. | 123/588 |
| 4,462,346 | | 7/1984 | Haman et al. | 123/73 A |
| 4,499,887 | | 2/1985 | Billingsley et al. | 123/575 |
| 4,542,723 | | 9/1985 | Fujimoto et al. | 123/187.5 R |
| 4,554,896 | | 11/1985 | Sougawa | 123/179 G |
| 4,915,085 | | 4/1990 | Staerzl | 123/587 |
| 5,000,134 | | 3/1991 | Fujimoto et al. | 123/73 A |
| 5,007,390 | | 4/1991 | Tanaka et al. | 123/180 T |
| 5,014,673 | | 5/1991 | Fujimoto et al. | 123/512 |
| 5,031,590 | | 7/1991 | Sakurai | 123/187.5 |
| 5,034,163 | | 7/1991 | Baltz et al. | 261/34.1 |
| 5,121,719 | | 6/1992 | Okazaki et al. | 123/179.14 |
| 5,150,673 | | 9/1992 | Hoshiba et al. | 123/179.15 |

FOREIGN PATENT DOCUMENTS

| | | | | |
|---|---|---|---|---|
| 1532732 | * | 11/1978 | (GB) | 261/39.5 |

* cited by examiner

*Primary Examiner*—Richard L. Chiesa
(74) *Attorney, Agent, or Firm*—Armstrong Teasdale LLP

(57) ABSTRACT

Disclosed herein is a fuel supply system comprising a carburetor including a fuel bowl, an air induction passage including therein a venturi, a throttle valve located in the air induction passage downstream of the venturi, a fuel enrichment conduit communicating between the fuel bowl and the air induction passage downstream of the throttle valve, and a temperature responsive valve for admitting air to the fuel enrichment conduit when the ambient temperature is above a predetermined level and for admitting air to the air induction passage when the engine temperature is below the predetermined level.

23 Claims, 2 Drawing Sheets

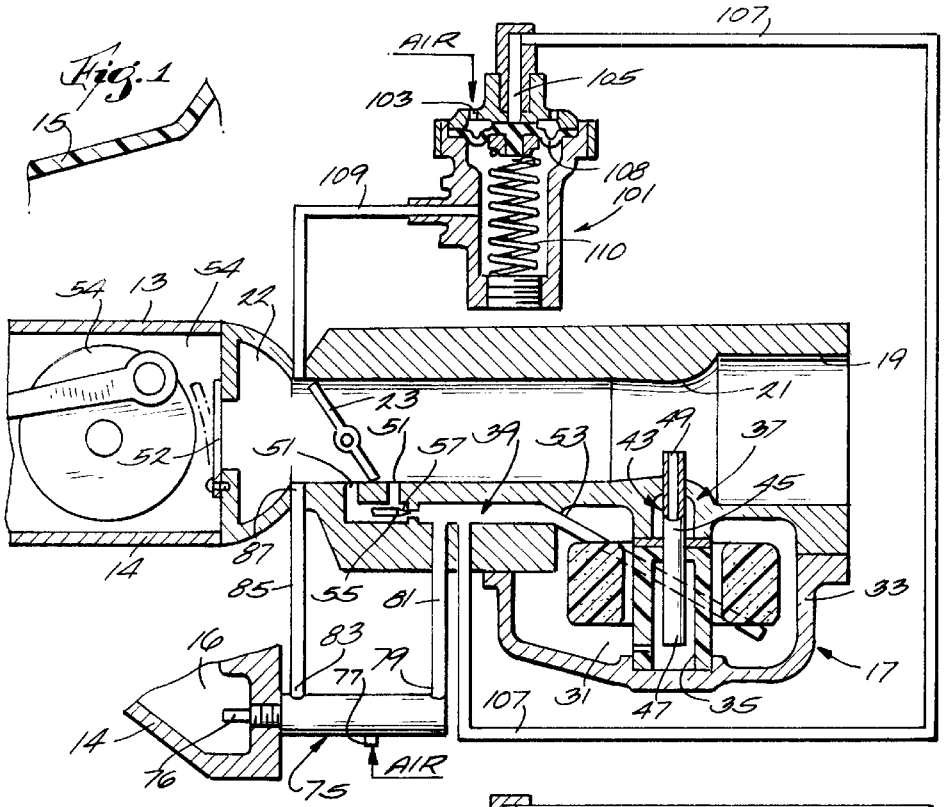
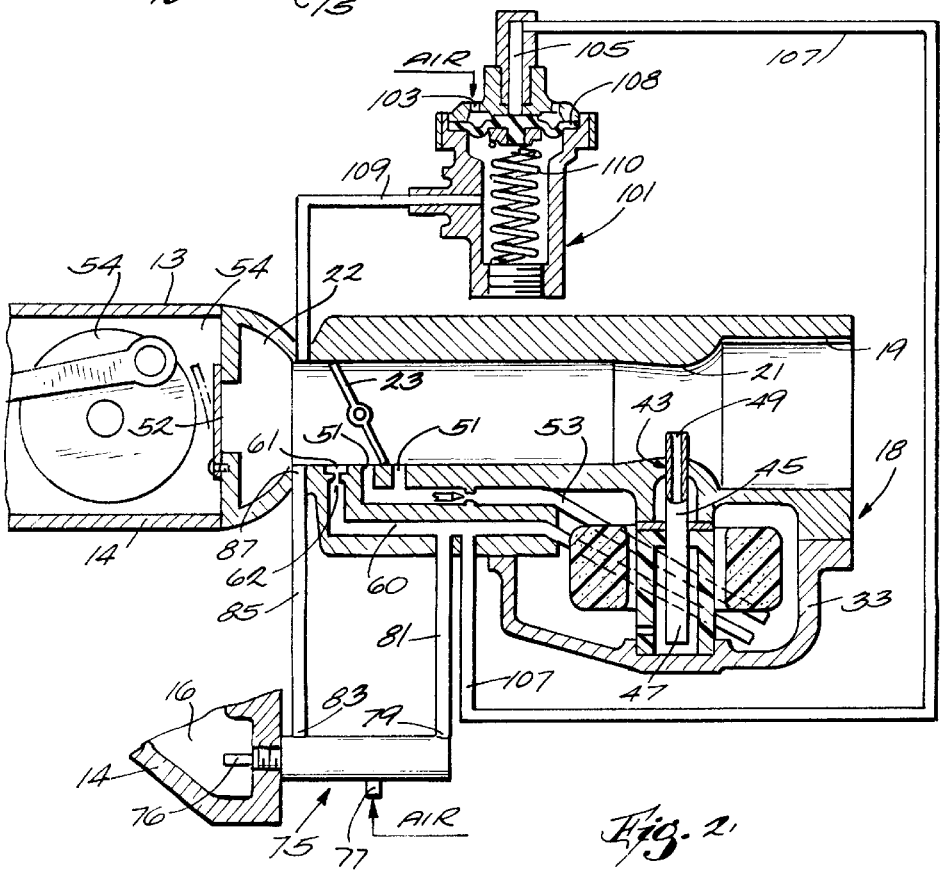
Fig. 2.

FUEL ENRICHMENT SYSTEM

BACKGROUND OF THE INVENTION

The invention relates generally to internal combustion engines which can be either of the two-stroke or four-stroke type. In addition, the invention relates to fuel feeding systems including systems for enriching fuel flow when the ambient air is below a predetermined temperature (and for discontinuing such fuel enrichment when the ambient air is above the predetermined temperature). Still further in addition, the invention relates to fuel feeding systems for enriching fuel flow when the vacuum condition in the air induction passage is above a predetermined absolute pressure and for discontinuing such enrichment when the vacuum condition in the air induction passage is below the predetermined absolute pressure.

SUMMARY OF THE INVENTION

The invention provides a fuel supply system for an internal combustion engine, which system comprises a carburetor a venturi, a throttle valve located in the air induction passage downstream of the venturi, a fuel enrichment conduit communicating between the fuel bowl and the air induction passage downstream of the throttle valve, and means for admitting air to the fuel enrichment conduit when the engine temperature is above a predetermined level and for admitting air to the air induction passage when the engine temperature is below the predetermined level.

The invention also provides a fuel supply system for an internal combustion engine, which system comprises a carburetor including a fuel bowl, an air induction passage including therein a venturi, a throttle valve located in the air induction passage downstream of the venturi, a fuel enrichment conduit communicating between the fuel bowl and the air induction passage downstream of the throttle valve, and means for admitting air to the fuel enrichment conduit when the engine temperature is above a predetermined level.

The invention also provides a fuel supply system for an internal combustion engine, which system comprises a carburetor including a fuel bowl, an air induction passage including therein a venturi, a throttle valve located in the air induction passage downstream of the venturi, a fuel enrichment conduit communicating between the fuel bowl and the air induction passage downstream of the throttle valve, and means for admitting air to the air induction passage when the engine temperature is below the predetermined level.

The invention also provides a fuel supply system comprising a carburetor including a fuel bowl, an air induction passage including therein a venturi, a throttle valve located in the air induction passage downstream of the venturi, a fuel enrichment conduit communicating between the fuel bowl and the air induction passage downstream of the throttle valve, and means responsive to the pressure in the air induction passage downstream of the throttle valve and communicating with the fuel enrichment conduit for admitting air to the fuel enrichment conduit when the pressure in the air induction passage downstream of the throttle valve is below a predetermined level.

The invention also provides a fuel supply system comprising a carburetor including a fuel bowl, an air induction passage including therein a venturi, a throttle valve located in the air induction passage downstream of the venturi, and means for supplying additional fuel to the air induction passage in response to the pressure condition in the air induction passage and including a pressure operated fuel pump having an outlet communicating with the air induction passage and having a pumping member subject to the pressure in the air induction passage.

Other features of and advantages of the invention will become apparent to those skilled in the art upon review of the following detailed description, claims, and drawings.

THE DRAWINGS

FIG. 1 is a schematic view, partially in section, of one embodiment a fuel feeding arrangement embodying various of the features of the invention.

FIG. 2 is a schematic view, partially in section, of a second embodiment of a fuel feeding arrangement embodying various of the features of the invention.

Figure 3:
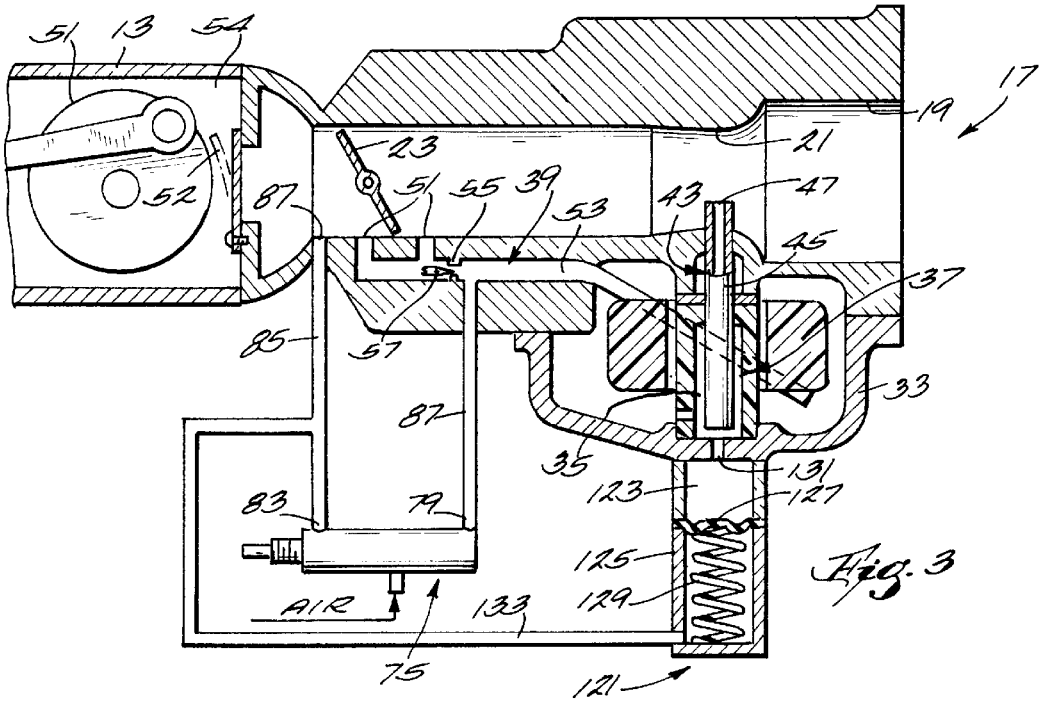
FIG. 3 is schematic view, partially in section, of a third embodiment of a fuel feeding arrangement embodying various of the features of the invention.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

GENERAL DESCRIPTION

Illustrated in the drawings is a fuel feeding or supply system 11 for an internal combustion engine 13 and particularly for a two-stroke internal combustion engine located within a surrounding cowling 15, as is commonly employed in an outboard motor, and including an engine block 14 which defines an engine coolant jacket 16. The internal combustion engine 13 also includes a fuel supply or feeding arrangement or system comprising a carburetor 17 having an air induction passage 19 including a venturi 21 for supplying a fuel/air mixture through an inlet manifold 22 to the engine 13.

Located in the air induction passage 19, upstream of an inlet manifold 22 and downstream of the venturi 21, is a pivotally mounted throttle valve member 23. Any suitable arrangement can be employed for operating the throttle valve member 23 between open and closed positions and for consequently controlling engine speed.

The carburetor 17 includes a fuel reservoir 31 in the form of a fuel bowl or float bowl 33 having a fuel well 35 together with main and secondary fuel feeding arrangements 37 and 39, respectively. More particularly, the main fuel feeding arrangement 37 includes a main nozzle 43 which is provided by a tube 45 which includes one end 47 extending into the fuel well 35 and an opposite end or outlet 49 extending into the venturi 21.

The secondary fuel system or idle circuit 39 comprises one or more secondary fuel inlet ports 51 located in the air induction passage 19 adjacent to and downstream of the throttle valve member 23, and upstream of the usual reed valve 52 controlling fuel/air mixture to an associated crankcase 54, together with a suitable conduit 53 between the secondary fuel port(s) 51 and the fuel well 35. The idle circuit 39 also includes, in the conduit 53, a suitable needle valve seat 55 and associated needle valve 57 which constitute an adjustable orifice for adjustably controlling the rate of flow in the idle circuit 39. As thus far disclosed, the construction is conventional.

In the construction disclosed, in FIG. 1, the idle circuit conduit 53 also serves as a fuel enrichment conduit and the needle valve 57 is adjusted to afford fuel flow at a rate to provide maximum fuel enrichment when the engine is cold and prior to initial engine operation, i.e., during cranking.

The carburetor 17 also includes means operable, when the temperature of the engine 13 is above a predetermined level, for admitting air into the idle circuit 39 so as to diminish the amount of fuel feed past the needle valve 57 in response to a given engine temperature condition thereby to provide lessened fuel enrichment at a rate less than maximum enrichment but greater than the fuel rate normally employed to sustain engine idle operation under hot engine conditions. Still further in addition, the carburetor 17 includes means operable, when the temperature is below said predetermine level, for admitting air to the air induction passage 19 so as to enhance the amount of air present to support fuel combustion, and thereby reduce the amount of unburnt fuel and to enable initial engine idle operation at a speed higher than idle speed under hot engine conditions.

While other constructions can be employed, the disclosed construction employs a conventional two-position, three port temperature responsive valve 75 known in the automotive field as a three port PVS valve produced by the Eaton Corporation. The temperature responsive valve 75 includes a first or air inlet port 77 communicating with the atmosphere (within the cowling 15), a second or hot port 79 communicating through a duct 81 with the idle circuit conduit 53 upstream of the needle valve 55, and a third or cold port 83 which communicates through a duct 85 with another port 87 located in the air induction passage 19 or inlet manifold 22 downstream of the throttle valve member 23 and upstream of the reed valve 52.

The two position, three port temperature responsive valve 75 includes a suitable internal mechanism (not specifically shown) comprising a valve member, and a thermostatic element 76 which extends into the engine coolant jacket 16 and which displaces the valve member in opposite directions so as to alternately connect the air inlet port 77 to the hot and cold ports 79 and 83 depending upon the engine temperature. Specifically, when the temperature of the engine coolant jacket 16 is below a predetermined temperature, the air inlet port 77 is connected to the cold port 83 to afford introduction into the induction passage 19 of additional air, and when the temperature in the coolant jacket 16 is above the predetermined level, the air inlet port 77 is connected to the hot port 79 to afford introduction of air into the conduit 53 with resultant reduction in the fuel flow rate in the conduit 53 past the needle valve 57 and into the air induction passage 19.

Other suitable arrangements in lieu of the valve 75, for instance, a bi-metallic element (not shown) for alternately controlling air flow to the ducts 81 and 85, can be employed. In addition, a separate temperature responsive valve which is normally open when the temperature is cold and a separate temperature responsive valve which is normally open when the temperature is hot can be employed.

While other constructions can be employed, in one embodiment of the invention, the enrichment fuel diminishment means also comprises means for admitting air to the idle circuit 39 in response to a level of vacuum in the air induction passage 19 above a predetermined level, i.e., an absolute pressure below a predetermined level.

More specifically, the carburetor 71 also includes means operable, in response to a given suction condition in the air induction passage 19 downstream of the throttle valve member 23, for diminishing the supply of enrichment fuel to the air induction passage 19 by introducing air into the idle circuit conduit 53 upstream of the needle valve 57 and thereby reducing the fuel flow rate in the conduit. When air is simultaneously being admitted to the conduit 53 through the conduit 81 when the engine is hot, the resultant fuel flow rate is that which sustains idle engine operation under hot engine conditions.

More particularly, such vacuum controlled air introducing means comprises a vacuum switch 101 which includes an air inlet port 103, an air outlet port 105 communicating through a duct 107 with the idle circuit conduit 53 between the needle valve 57 and the fuel bowl 33, and a valve member 108 which is movable between open and closed positions, which is exposed through a duct or port 109 to the pressure condition in the air induction passage 19 downstream of the throttle valve member 23, which is biased to the closed position by a spring 110 preventing communication between the air inlet port 103 and the outlet port 105 consequent to a vacuum condition in the air induction passage 19 below a predetermined level, i.e., when the absolute pressure is above a predetermined amount, and which is operative to provide communication between the air inlet port 103 and the outlet port 105 when the valve member is in the open position consequent to a vacuum condition in the air induction passage 19 above the predetermined suction level, i.e., when the absolute pressure is below the predetermined amount.

As a consequence of the admission of air into the idle circuit conduit 53 upstream of the needle valve, lesser fuel flow occurs past the needle valve 57 and into the air induction passage 19, thereby providing, when the engine is cold, a fuel flow rate between maximum enrichment and hot engine idle operation and providing, when the engine is hot, the fuel flow normally employed for sustaining engine idle operation.

In operation of the embodiment shown in FIG. 1, during starting, i.e., during cranking and initial engine operation, and when the engine 13 is cold, the temperature operated valve or switch 75 operates to open the cold port 83 and to permit air flow to the air induction passage 19 through the duct 85, thereby supplying additional air to facilitate more complete burning of the fuel and, hence, increased idle engine speed resulting in more reliable idle operation. At the same time, the hot port 79 is closed, thereby preventing air flow through the duct 81 to the idle circuit conduit 53 and thereby avoiding enrichment fuel flow diminishment due to hot engine temperature. At the same time, during cranking, but not during initial engine operation, the vacuum in the air induction passage 19 is insufficient to open the vacuum switch or valve 101. Thus, air is not admitted through the duct 107 to the idle circuit conduit 53 and maximum fuel enrichment occurs. Consequent to initial engine operation, the suction level increases in the induction passage 19, i.e., absolute pressure decreases, thereby opening the vacuum switch or valve 101, and thereby admitting atmospheric air to the idle circuit conduit 53 upstream of the needle valve 57, and thereby reducing the fuel flow rate from maximum fuel enrichment to a lower level of fuel enrichment.

As the engine warms up, the temperature responsive valve 75 changes position so that the cold port 83 is closed, thereby discontinuing additional air supply to the air induction passage 19, and the hot port 79 is opened, thereby supplying air to the idle circuit conduit 53 upstream of the needle valve 57, and thereby further reducing the rate of fuel flow to substantially eliminate enrichment fuel delivery and thereby to provide fuel flow for normal engine idle operation under hot engine conditions.

During hot starting conditions, and during cranking when the valve 101 is closed, the three-way valve 75 is operative to close the cold start port 83 and open the hot start port 79. Such action supplies air to the idle circuit conduit 53 upstream of the needle valve 57, thereby reducing the fuel flow rate from maximum enrichment. When ignition takes hold during initial engine operation, the suction in the air induction passage 13 increases sufficiently to open the valve 101 and thereby cause air flow through conduit 107 and into the idle circuit conduit 53 upstream of the needle valve 57, thereby further reducing the fuel flow rate to the rate operable to sustain idle engine operation under hot conditions.

The disclosed system automatically provides the additional fuel needed for cold and hot starting an internal combustion engine. By reacting to changes in engine temperature and to changes in the vacuum in the induction passage 19 downstream of the throttle 23, the amount of enrichment is varied to maintain an adequately rich air/fuel mixture and also to provide some additional air flow which raises the engine speed enough to stabilize and enhance the running quality at idle engine operation. This is accomplished by bleeding off unneeded enrichment rather than controlling a choke plate. A typical application would be on an outboard motor. Operator actions such as advancing the throttle/spark control to a start position and pulling a choke knob out or pushing in a primer knob are not required. Simply pulling the starter cord or turning the key to start position, after locating the throttle valve in the idle position, is all that is required to start and continue to run at any temperature between 20° and 140° F. This system will work equally well on any carbureted internal combustion engine using gasoline, kerosine, or alcohol as a combustible fuel.

While the embodiment shown in FIG. 1 employs the idle circuit conduit 53 for providing fuel enrichment, such fuel enrichment can be provided in a carburetor independently of the idle circuit conduit 53. Specifically, shown in FIG. 2 is a second embodiment of a fuel feeding arrangement which includes a carburetor 18 and which is the same in all respects as in FIG. 1 except that there is provided a fuel enrichment conduit 60 which extends between the fuel reservoir 31 and a port or orifice 61 communicating with the air induction passage 19 downstream of the throttle valve member 23, and except that, in the carburetor 18, the conduits 107 and 81 communicate with the fuel enrichment conduit 60 upstream of the port or orifice 61 and not with the idle circuit conduit 53. If desired, an adjustable orifice, such as the before mentioned needle valve 57 and valve seat 55, could be employed.

The operation of the carburetor 18 shown in FIG. 2 is substantially the same as that explained with respect to the carburetor 17 shown in FIG. 1 except that the idle circuit conduit 53 does not supply enrichment fuel but does supply fuel for idle operation under hot and cold engine conditions. During cranking, and prior to initial engine operation, when the engine is cold, the fuel enrichment conduit 60 supplies maximum fuel enrichment in addition to the fuel supplied by the idle circuit conduit 53. When the vacuum switch 101 opens upon initial engine operation, air is supplied to the enrichment conduit 60 and the enrichment fuel flow rate is diminished or reduced. When the engine warms up and the temperature switch 75 closes the cold port 83 and opens the hot port 79, sufficient additional air is supplied to the enrichment conduit 60, to eliminate fuel flow in the enrichment conduit. The engine however, will continue to run at idle speed under hot conditions due to the fuel supplied by the idle circuit conduit 53.

During hot starting conditions and during cranking, the hot port 79 is opened and supplies air to the enrichment conduit 60, while at the same time, the vacuum switch 101 is closed. Consequently, enrichment fuel is supplied through the enrichment conduit 60 at a rate less than maximum. When ignition takes hold and initial engine operation takes place, the vacuum switch 101 opens, thereby supplying further air to the enrichment conduit 60 and discontinuing fuel flow in the enrichment conduit 60.

Alternatively, and in place of the vacuum switch 101 and the duct 107, the carburetor 17 can include, as shown in FIG. 3, means for supplying enrichment fuel (independently of the idle circuit conduit 53 or the enrichment conduit 60) in the form of a vacuum operated fuel enrichment pump 121 which operates in response to an increase in absolute pressure. Fuel enrichment for offsetting cold start conditions as explained with respect to FIGS. 1 and 2 is included in the embodiment shown in FIG. 3. More particularly, in the embodiment shown in FIG. 3, the numerals used in the FIG. 1 embodiment are applied to the same structure in the FIG. 3 embodiment.

The fuel enrichment pump 121 includes a fuel recess or chamber 123 which is defined, in part, by a housing 125 and by a diaphragm 127 and which receives fuel from the fuel well 35 through a small restricted opening or orifice 131. Alternatively, a one-way valve, not shown, could be employed. The diaphragm 127 is biased by a spring 129 in the direction to discharge or pump enrichment fuel from the chamber 123 into the fuel well 35 and, hence, through the tube 45 and out the main nozzle 43 into the air induction passage 19. The diaphragm 127 is also subject, through a duct 133, to the pressure in the duct 85 extending between the cold port 83 of the temperature responsive valve 75 and the port 87 in the air induction passage 19. As a consequence, when the temperature is above a given level, i.e., when the cold port 83 is closed, the diaphragm 127 is subject to the vacuum condition in the air induction passage 19. Consequently, in response to a vacuum level increase, i.e., a diminishment in the absolute pressure, the action of the spring will be diminished, and the diaphragm 127 will enlarge the pumping chamber 123 and draw fuel thereinto.

When the vacuum or suction level in the air induction passage 19 decreases, i.e., when the absolute pressure increases, the spring 129 will deflect the diaphragm 127 so as to effect pumping of fuel through the main nozzle 43 into the venturi 21 of the air induction passage 19.

Figure 4:
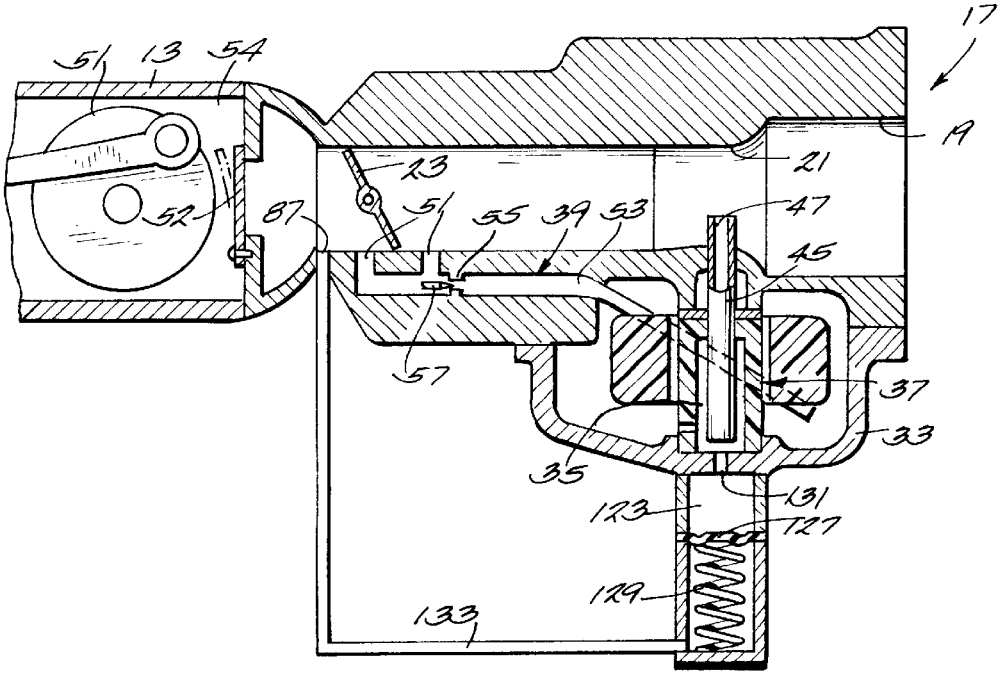
FIG. 4 is a schematic view, partially in section, of a fourth embodiment of a fuel feeding arrangement embodying various of the features of the invention.

Alternatively, the fuel enrichment pump 121 can be employed is another embodiment which is shown in FIG. 4, which omits the three-way valve 75, and which is otherwise the same as the construction shown in FIG. 3, including the presence of a conventional idle operation circuit conduit 53.

During engine cranking, the vacuum condition in the inlet manifold 22 varies or fluctuates, causing, in the embodiment shown in FIGS. 3 and 4, responsive pumping movement of the diaphragm 127 and consequent production of fuel pulses delivered to the outlet 49 of the main nozzle 43.

Various features of the invention are set forth in the following claims.

What is claimed is:

1. A fuel supply system for an internal combustion engine, said system comprising a carburetor including a fuel bowl, an air induction passage including therein a venturi, a throttle valve located in said air induction passage downstream of said venturi, a fuel enrichment conduit communicating between said fuel bowl and said air induction passage downstream of said throttle valve for delivering fuel unmixed with air to said air induction passage when the engine temperature is below a predetermined temperature level, a temperature responsive valve including a first port communicating with the atmosphere, a second port communicating with the fuel enrichment conduit between the fuel bowl and said air induction passage, a third port communicating with said air induction passage downstream of said throttle valve, and means including a temperature responsive element operative alternately for communicating said first and second ports when the engine temperature is above a predetermined temperature level and for communicating said first and third ports when the engine temperature is below said predetermined temperature level, whereby air is admitted to said fuel enrichment conduit when the engine temperature is above said predetermined temperature level and air is admitted to said air induction passage when the engine temperature is below said predetermined temperature level.

2. A fuel supply system in accordance with claim 1 wherein said fuel enrichment conduit also serves as an idle circuit conduit.

3. A fuel supply system in accordance with claim 1 wherein said fuel enrichment conduit includes a flow restriction between said air induction passage and said fuel bowl, and wherein said second port communicates with said fuel enrichment conduit between said flow restriction and said fuel bowl.

4. A fuel supply system in accordance with claim 1 wherein said temperature responsive element is adapted to be located in a coolant jacket of the engine.

5. A fuel supply system in accordance with claim 1 and further including means responsive to the pressure in said air induction passage and communicating with said fuel enrichment conduit for admitting air to said fuel enrichment conduit.

6. A fuel supply system in accordance with claim 5 wherein said fuel enrichment conduit includes a flow restriction between said air induction passage and said fuel bowl, and wherein said pressure responsive means for admitting air into said fuel enrichment conduit communicates with said fuel enrichment conduit between said flow restriction and said fuel bowl.

7. A fuel supply system in accordance with claim 6 wherein said pressure responsive means for admitting air to said fuel enrichment conduit includes a valve including a valve member subject to the pressure in said air induction passage downstream of said throttle valve, an air inlet port, and an air outlet port communicating with said fuel enrichment conduit between said restriction and said fuel bowl, said valve being operative to provide communication between said inlet and said outlet ports when the pressure in said air induction passage is below a predetermined absolute pressure and to prevent communication between said inlet and outlet ports when said pressure is above said predetermined absolute pressure.

8. A fuel supply system in accordance with claim 1 and further including means for supplying additional fuel to said air induction passage in response to the pressure condition in said air induction passage.

9. A fuel supply system in accordance with claim 8 wherein said means for supplying additional fuel comprises a pressure operated fuel pump having an outlet communicating with said induction passage and including a pumping member subject to the pressure in said air induction passage.

10. A fuel supply system in accordance with claim 9 wherein said fuel bowl includes a fuel well, wherein said carburetor also includes a main nozzle communicating between said fuel well and said air induction passage, wherein said pressure operated fuel pump communicates with said fuel well and includes a spring biasing said pumping member in the direction to discharge fuel into said fuel well, and wherein a negative pressure condition in said air induction passage acts in opposition to said spring.

11. A fuel supply system in accordance with claim 1 and further including an idle circuit conduit communicating independently of said fuel enrichment conduit between said fuel bowl and said air induction passage downstream of said throttle valve.

12. A fuel supply system comprising a carburetor including a fuel bowl, an air induction passage including therein a venturi, a throttle valve located in said air induction passage downstream of said venturi, a fuel enrichment conduit openly communicating between said fuel bowl and said air induction passage downstream of said throttle valve at all times for delivering fuel unmixed with air to said air induction passage downstream of said throttle valve when the engine temperature is below a predetermined level, and means for admitting air to said fuel enrichment conduit when the engine temperature is above said predetermined level.

13. A fuel supply system in accordance with claim 12 wherein said fuel enrichment conduit includes a flow restriction between said air induction passage and said fuel bowl, and wherein said means for admitting air to said fuel enrichment conduit when the temperature is above a predetermined level communicates with said fuel enrichment conduit between said flow restriction and said fuel bowl.

14. A fuel supply system in accordance with claim 12 and further including means responsive to the pressure in said air induction passage and communicating with said fuel enrichment conduit for admitting air to said fuel enrichment conduit.

15. A fuel supply system comprising a carburetor including a fuel bowl, an air induction passage including therein a venturi, a throttle valve located in said air induction passage downstream of said venturi, a fuel enrichment conduit openly communicating between said fuel bowl and said air induction passage downstream of said throttle valve at all times for delivering fuel unmixed with air to said air induction passage when the engine temperature is below a Predetermined level, and means for admitting air to said air induction passage when the engine temperature is below said predetermined level.

16. A fuel supply system in accordance with claim 15 and further including means responsive to the pressure in said air induction passage and communicating with said fuel enrichment conduit for admitting air to said fuel enrichment conduit.

17. A fuel supply system comprising a carburetor including a fuel bowl, an air induction passage including therein a venturi, a throttle valve located in said air induction passage downstream of said venturi, a fuel enrichment conduit communicating between said fuel bowl and said air induction passage downstream of said throttle valve for delivering fuel unmixed with air to said air induction passage when the pressure in said air induction passage downstream of said throttle valve is above a predetermined level, and means responsive to the pressure in said air induction passage downstream of said throttle valve and communicating with said fuel enrichment conduit between said fuel bowl and said air induction passage for admitting air into said fuel enrichment conduit when the pressure in said air induction passage downstream of said throttle valve is below said predetermined level and independently of engine temperature.

18. A fuel supply system in accordance with claim 17 wherein said fuel enrichment conduit also serves as an idle circuit conduit.

19. A fuel supply system in accordance with claim 17 wherein said fuel enrichment conduit includes a flow restriction between said air induction passage and said fuel bowl, and wherein said pressure responsive means for admitting air into said fuel enrichment conduit communicates with said fuel enrichment conduit between said flow restriction and said fuel bowl.

20. A fuel supply system in accordance with claim 19 wherein said pressure responsive means for admitting air to said fuel enrichment conduit includes a valve including a valve member subject to the pressure in said air induction passage downstream of said throttle valve, an air inlet port, and an air outlet port communicating with said fuel enrichment conduit between said restriction and said fuel bowl, said valve being operative to provide communication between said inlet and said outlet ports when the pressure in said air induction passage is below said predetermined level and to prevent communication between said inlet and outlet ports when said pressure is above said predetermined level.

21. A fuel supply system for an internal combustion engine, said system comprising a carburetor including a fuel bowl, an air induction passage including therein a venturi, a throttle valve located in said air induction passage downstream of said venturi, a fuel enrichment conduit communicating between said fuel bowl and said air induction passage downstream of said throttle valve for delivering fuel unmixed with air to said air induction passage when the engine temperature is below a temperature predetermined level and the pressure in said air induction passage downstream of said throttle valve is above a predetermined pressure, a temperature responsive valve including a first port communicating with the atmosphere, a second port communicating with the fuel enrichment conduit between said fuel bowl and said air induction passage, a third port communicating with said air induction passage downstream of said throttle valve, and means including a thermally responsive member operative alternately for communicating said first and second ports when the engine temperature is above a predetermined temperature level and for communicating said first and third ports when the engine temperature is below said predetermined temperature level, whereby air is admitted to said fuel enrichment conduit when the engine temperature is above said predetermined temperature level and air is admitted to said air induction passage when the engine temperature is below said predetermined temperature level, and means responsive to the pressure in said air induction passage downstream of said throttle valve and communicating with said fuel enrichment conduit between said fuel bowl and said air induction passage for admitting air into said fuel enrichment conduit when the pressure in said air induction passage downstream of said throttle valve is below said predetermined level.

22. A fuel supply system comprising a carburetor including a fuel bowl, an air induction passage including therein a venturi, a throttle valve located in said air induction passage downstream of said venturi, a main nozzle communicating between said fuel bowl and said air induction passage, a fuel enrichment conduit openly communicating at all times between said fuel bowl and said air induction passage downstream of said throttle valve and independently of the communication of said main nozzle with said fuel bowl for delivering fuel unmixed with air to said air induction passage when the engine temperature is below a predetermined level, means for admitting air to said air induction passage when the engine temperature is below said predetermined level, and means responsive to the pressure in said air induction passage and communicating with said fuel enrichment conduit for admitting air to said fuel enrichment conduit.

23. A fuel supply system comprising a carburetor including a fuel bowl, an air induction passage including therein a venturi, a throttle valve located in said air induction passage downstream of said venturi, a main nozzle communicating between said fuel bowl and said air induction passage, a fuel enrichment conduit communicating between said fuel bowl and said air induction passage downstream of said throttle valve and independently of the communication of said main nozzle with said fuel bowl for delivering fuel unmixed with air to said air induction passage when the pressure in said air induction passage downstream of said throttle valve is above a predetermined level, and means responsive to the pressure in said air induction passage downstream of said throttle valve and communicating with said fuel enrichment conduit between said fuel bowl and said air induction passage for admitting air into said fuel enrichment conduit when the pressure in said air induction passage downstream of said throttle valve is below said predetermined level and independently of engine temperature.

* * * * *